US011292112B2

(12) United States Patent
Gaul

(10) Patent No.: US 11,292,112 B2
(45) Date of Patent: Apr. 5, 2022

(54) SETTING METHOD FOR EXPANSION ANCHORS BY MEANS OF AN IMPACT WRENCH

(71) Applicant: Hilti Aktiengesellschaft, Schaan (LI)

(72) Inventor: Hans-Dieter Gaul, Augsburg (DE)

(73) Assignee: Hilti Aktiengesellschaft, Schaan (LI)

( * ) Notice: Subject to any disclaimer, the term of this patent is extended or adjusted under 35 U.S.C. 154(b) by 140 days.

(21) Appl. No.: 16/764,427

(22) PCT Filed: Dec. 4, 2018

(86) PCT No.: PCT/EP2018/083504

§ 371 (c)(1),
(2) Date: May 15, 2020

(87) PCT Pub. No.: WO2019/120989

PCT Pub. Date: Jun. 27, 2019

(65) Prior Publication Data

US 2020/0384620 A1 Dec. 10, 2020

(30) Foreign Application Priority Data

Dec. 20, 2017 (EP) ..... 17208782

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01)

(58) Field of Classification Search
CPC ..... B25B 23/1475; B25B 21/02; B25B 31/00; F16B 13/065; F16B 13/066; F16B 13/06; F16B 13/0858

(Continued)

(56) References Cited

U.S. PATENT DOCUMENTS 4,051,990 A * 10/1977 Chromy ..... B25B 31/00 227/10
4,646,410 A * 3/1987 Good ..... B25B 27/026 29/252

(Continued)

FOREIGN PATENT DOCUMENTS

CN 1590029 A 3/2005
CN 102653050 A 9/2012

(Continued)

OTHER PUBLICATIONS

International Search Report of PCT/EP2018/083504, dated Feb. 18, 2019.

*Primary Examiner* — Dariush Seif
(74) *Attorney, Agent, or Firm* — Davidson, Davidson & Kappel, LLC

(57) ABSTRACT

A setting method for expansion anchors via an impact wrench has a first phase S1 and a second phase S2. In the first phase, a rotary impact is repeatedly exerted on a screw element of the expansion anchor and a torque transmitted from the rotary impact to the screw head is estimated. The first phase S1 is ended when the estimated transmitted torque exceeds a threshold value specified for the expansion anchor. During the second phase, a first number of rotary impacts specified for the expansion anchor are exerted on the screw head. A current rate of change of the estimated torque is monitored at least during the first phase. In response to the current rate of change exceeding a limit value for the rate of change specified for the expansion anchor, a modified second phase is started, in which a second number of rotary impacts specified for the expansion anchor are exerted on the screw head, the second number being less than the first number.

4 Claims, 6 Drawing Sheets

(58) Field of Classification Search
USPC ..... 173/1, 93.5; 411/44, 45
See application file for complete search history.

(56) References Cited

U.S. PATENT DOCUMENTS 5,666,779 A * 9/1997 Fuchs ..... F16B 13/0833 52/705
5,715,894 A * 2/1998 Maruyama ..... B25B 23/1453 173/180
6,371,218 B1 * 4/2002 Amano ..... B25B 23/1405 173/176
6,829,871 B1 * 12/2004 McSherry ..... F16B 13/066 403/368
9,254,516 B2 * 2/2016 Kind ..... F16B 13/065
2003/0009262 A1 * 1/2003 Colangelo, III .... B25B 23/1456 700/275
2005/0045353 A1 * 3/2005 Kawai ..... B25B 21/02 173/181
2008/0075553 A1 * 3/2008 Gonzalez Carquijero ..... F16B 13/141 411/82.1
2008/0310930 A1 * 12/2008 Schaeffer ..... B23B 37/00 411/55
2009/0084568 A1 * 4/2009 Arimura ..... B25B 23/1405 173/104
2011/0081217 A1 * 4/2011 Wissling ..... F16B 13/066 411/45
2012/0222876 A1 * 9/2012 Schmidt ..... B25B 23/1475 173/1
2012/0318552 A1 * 12/2012 May ..... B25B 23/1405 173/181
2013/0097845 A1 * 4/2013 Schaeffer ..... F16B 13/066 29/525.01
2013/0115025 A1 * 5/2013 Selb ..... B21H 1/20 411/378
2013/0153252 A1 * 6/2013 Sakakibara ..... B25B 21/008 173/1
2014/0072384 A1 * 3/2014 Wissling ..... E04B 1/40 411/44
2014/0133933 A1 * 5/2014 Shimahara ..... B21H 3/06 411/44
2015/0047866 A1 * 2/2015 Sakai ..... B25F 5/00 173/179
2015/0167715 A1 * 6/2015 Hakenholt ..... F16B 13/065 166/381
2016/0053792 A1 * 2/2016 Rosenkranz ..... F16B 13/066 29/428
2016/0053794 A1 * 2/2016 Anasis ..... F16B 37/14 411/60.1
2016/0238051 A1 * 8/2016 Schaeffer ..... F16B 13/065
2016/0238052 A1 * 8/2016 Schaeffer ..... F16B 13/065
2016/0252120 A1 * 9/2016 Gstach ..... F16B 13/065 411/55
2016/0252121 A1 * 9/2016 Gstach ..... F16B 13/065 411/55
2016/0273570 A1 * 9/2016 Pourtier ..... F16B 13/065
2016/0290379 A1 * 10/2016 Gstach ..... F16B 13/065
2016/0298667 A1 * 10/2016 Gstach ..... F16B 13/065
2017/0232589 A1 * 8/2017 Gaul ..... B25B 31/00 29/407.02
2017/0232597 A1 * 8/2017 Gaul ..... B25B 23/1475 29/407.02

FOREIGN PATENT DOCUMENTS

DE 102005015900 A1 2/2006
EP 0285815 A1 10/1998
EP 0559937 A1 2/2016
EP 2985118 A1 2/2016

* cited by examiner

SETTING METHOD FOR EXPANSION ANCHORS BY MEANS OF AN IMPACT WRENCH

FIELD OF THE INVENTION

The present invention relates to a setting method for expansion anchors, which is implemented as a control method for an impact wrench.

BACKGROUND

Expansion anchors are used, among other things, to secure structural beams. The structural beams are usually provisionally secured and are aligned thereafter. To do this, the user loosens the expansion anchor and tightens it again after alignment. Improper second tightening can damage the expansion anchor.

SUMMARY OF THE INVENTION

One embodiment of a setting method for expansion anchors by means of an impact wrench has a first phase S1 and a second phase S2. In the first phase, a rotary impact is repeatedly exerted on a screw element of the expansion anchor and a torque transmitted from the rotary impact to the screw head is estimated. The first phase S1 is ended when the estimated transmitted torque exceeds a threshold value specified for the expansion anchor. During the second phase, a first number of rotary impacts specified for the expansion anchor are exerted on the screw head. A current rate of change of the estimated torque is monitored at least during the first phase. In response to the current rate of change exceeding a limit value for the rate of change specified for the expansion anchor, a modified second phase is started, in which a second number of rotary impacts specified for the expansion anchor are exerted on the screw head, the second number being less than the first number.

BRIEF DESCRIPTION OF THE FIGURES

The following description explains the invention with reference to exemplary embodiments and figures, in which.

Identical or functionally identical elements are indicated by the same reference signs in the figures, unless stated otherwise.

DETAILED DESCRIPTION

Impact Wrench

Figure 1:
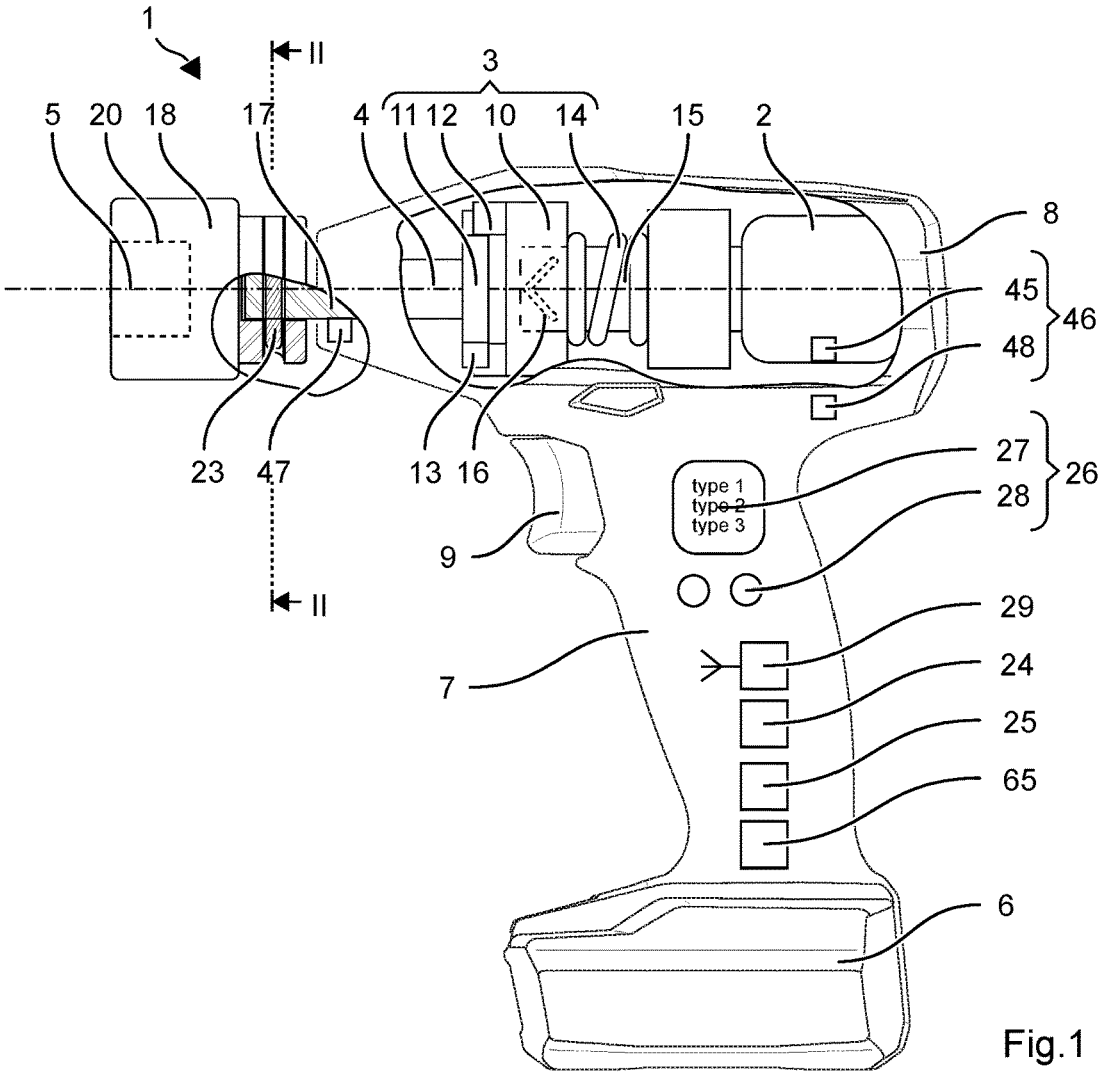
FIG. 1 shows an impact wrench

[0005] schematically shows the impact wrench 1. The impact wrench 1 has an electric motor 2, an impact mechanism 3 and an output spindle 4. The impact mechanism 3 is continuously driven by the electric motor 2. As soon as a reactive torque of the output spindle 4 exceeds a threshold value, the impact mechanism 3 repeatedly exerts angular momentum (rotary impacts) on the output spindle 4 with a momentary but very high torque. Accordingly, the output spindle 4 rotates continuously or in stages about a working axis 5. The electric motor 2 can be powered by a battery 6 or can be mains-powered.

The impact wrench 1 has a handle 7 by means of which the user can hold and guide the impact wrench 1 during operation. The handle 7 can be fastened rigidly or by means of damping elements to a machine housing 8. The electric motor 2 and the impact mechanism 3 are arranged in the machine housing 8. The electric motor 2 can be switched on and off by means of a button 9. The button 9 is arranged directly on the handle 7, for example, and can be pressed by the hand enclosing the handle.

The exemplary impact mechanism 3 has a hammer 10 and an anvil 11. The hammer 10 has claws 12 which abut claws 13 of the anvil 11 in the direction of rotation. The hammer 10 can transmit a continuous torque or momentary angular momentum to the anvil 11 via the claws 12. A coil spring 14 preloads the hammer 10 in the direction of the anvil 11, as a result of which the hammer 10 is held in engagement with the anvil 11. If the torque exceeds the threshold value, the hammer 10 moves against the force of the coil spring until the claws 12 are no longer in engagement with the anvil 11. The electric motor 2 can accelerate the hammer 10 in the direction of rotation until the hammer 10 is again forced into engagement with the anvil 11 by the coil spring 14. The hammer 10 transfers the kinetic energy gained in the meantime to the anvil 11 in one short burst. According to one embodiment, the hammer 10 is positively guided on a drive spindle 15 along a spiral path 16. The positive guidance can be implemented, for example, as a spiral depression in the drive spindle 15 and a pin of the hammer 10 engaging in the depression. The drive spindle 15 is driven by the electric motor 2.

The output spindle 4 protrudes from the machine housing 8. The protruding end forms a tool holder 17. The exemplary tool holder 17 has a square cross section. A socket 18 or similar tool can be placed on the tool holder 17. The socket 18 has a bushing with a square hollow cross section, the dimensions of which substantially correspond to the tool holder 17. Opposite the bushing, the socket 18 has a mouth 20 for receiving the screw head 21, i.e. the hexagon nut 22 or a similar screw. The socket 18 can be secured to the output spindle 4 by means of a tool lock 23. The tool lock 23 is based, for example, on a pin which is inserted both through a bore in the output spindle 4 and in the socket 18.

The impact wrench 1 has a control unit 24. The control unit 24 can be implemented, for example, by a microprocessor and an external or integrated memory 25. Instead of a microprocessor, the control unit can consist of equivalent discrete components, an ASIC, an ASSP, etc.

The impact wrench 1 has an input element 26 via which the user can select an operating mode. The control unit 24 then controls the impact wrench 1 in accordance with the selected operating mode. The control sequences of the different operating modes can be stored in the memory 25. The operating modes include, among other things, a setting method for expansion anchors and a setting method for screw connections in steel construction.

Figure 2:
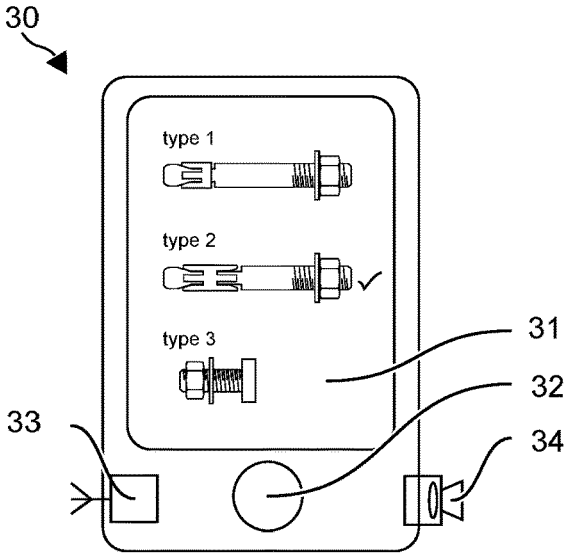
FIG. 2 shows an input element
Figure 3:
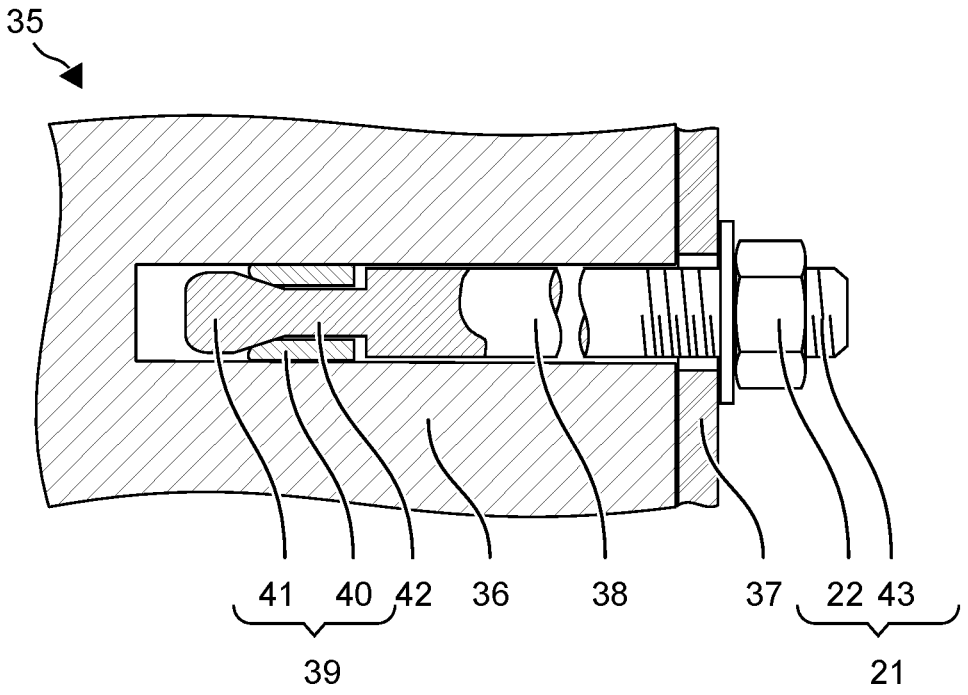
FIG. 3 shows an expansion anchor
Figure 4:
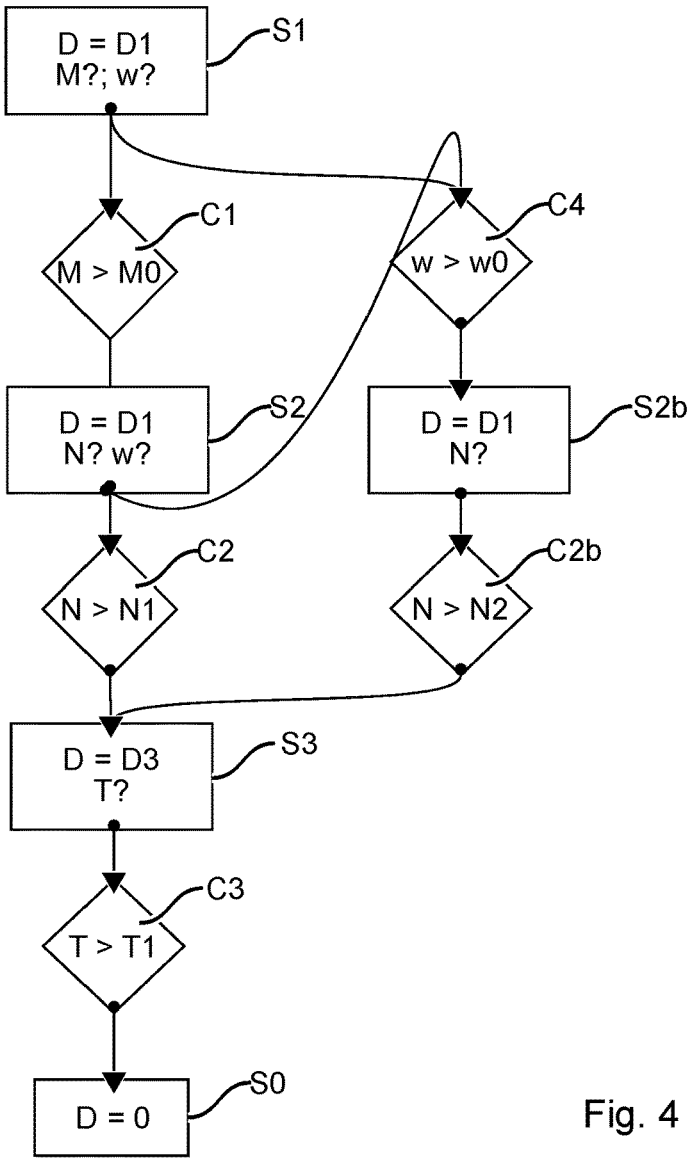
FIG. 4 is a flowchart for the "Expansion anchor" operating mode
Figure 5:
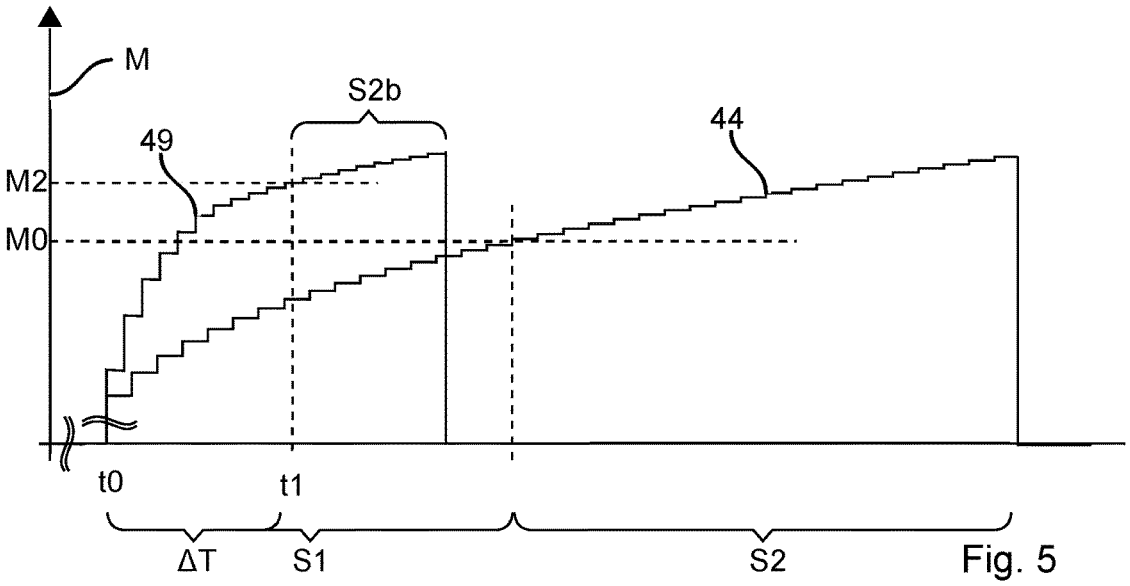
FIG. 5 shows a curve of the estimated torque
Figure 6:
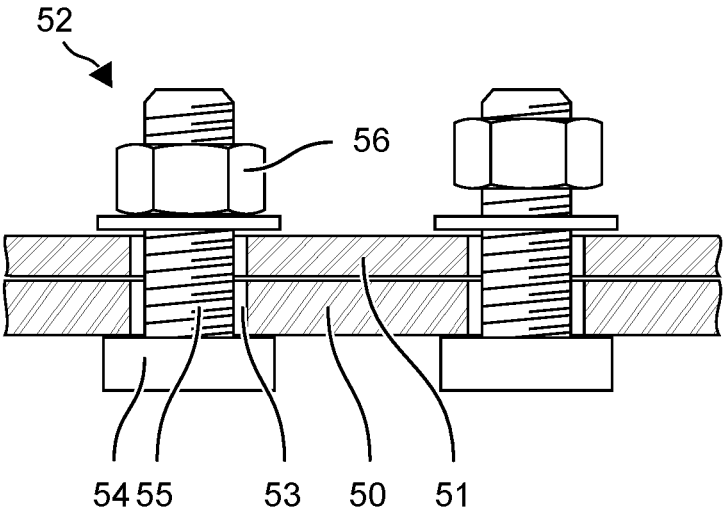
FIG. 6 shows a screw connection of two steel plates
Figure 7:
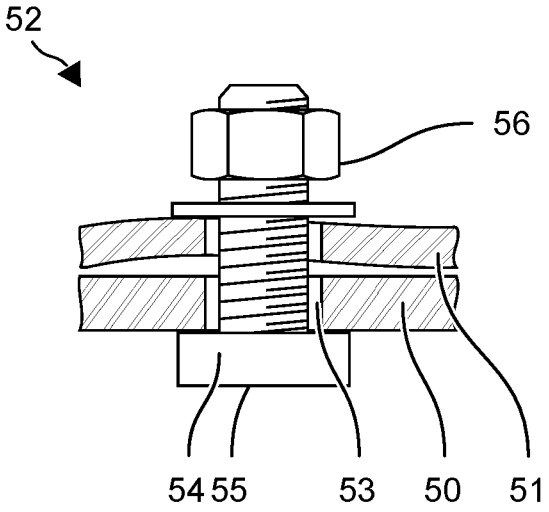
FIG. 7 shows a screw connection of two steel plates
Figure 8:
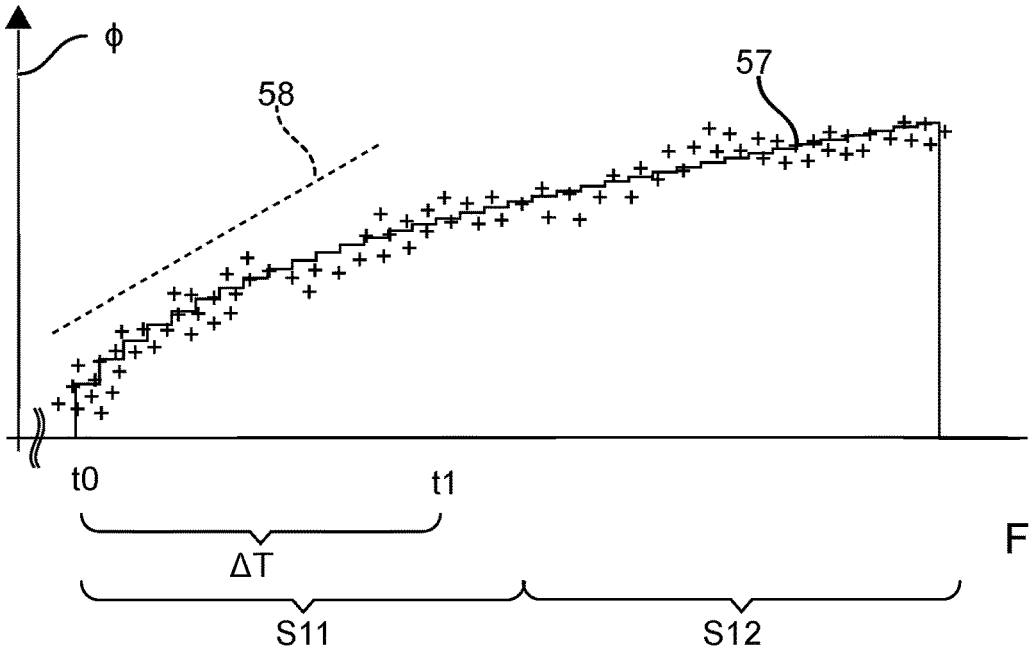
FIG. 8 shows a curve of an angle of rotation

The input element 26 can include, for example, a display 27 and one or more input buttons 28. The control unit 24 can display the various operating modes stored in the memory 25 and any connection types associated therewith. The user can select the operating mode using the input buttons 28. In addition, the user can input specifications such as size, diameter, length, target torque, load capacity or manufacturer name of a connection type. In an alternative embodiment, the impact wrench 1 has a communication interface 29 which communicates with an external input element 30, as shown in FIG. 2. The external input element 30 can be, for example, a cell phone, a laptop or an analog mobile device. Furthermore, the input element can be an additional module, which can be arranged as an adapter between the impact wrench 1 and the battery 6. Several connection types are stored in an application executed on the input element 30, or the application can query these from a server via a mobile radio interface. The external input element 30 can show the expansion anchors or relevant information regarding the connection type on a display 31. The user selects a connection type using an input button 32 or a touch-sensitive display 31. The external input element 30 transmits the type designation or parameters of the selected connection type relevant for the control method to the impact wrench 1 via a communication interface 33 to the communication interface 29 of the impact wrench 1. The communication interface 29 is preferably radio-based, e.g. using a Bluetooth standard. In addition or alternatively, the internal input element 28 or the external input element 30 can be provided with a camera 34 which can detect a barcode on packaging of the connection type. The input element 28 determines the connection type based on the detected barcode and the barcodes stored in the memory 25. Instead of a camera 34, a laser-based barcode reader, an RFID reader, etc. can be used to detect a label on the packaging or on the connection type. In a further embodiment, image processing in the input element 28 can identify the connection type on the basis of an image captured by the camera 34, or can at least limit a selection of connection types presented to the user based on the image.

Expansion Anchor

[0007] shows an expansion anchor 35 which is anchored in a wall 36 so as to fasten an attachment 37 to the wall 36. The expansion anchor 35 has an anchor rod 38. At one end of the anchor rod 38 is a screw head 21. An expansion mechanism 39 is provided at an end remote from the screw head 21. The expansion mechanism 39 is inserted into a borehole in the wall 36. The expansion mechanism 39 converts a tensile stress from the screw head 21 acting on the expansion mechanism 39 into a radial clamping force against the inner wall of the borehole. The expansion anchor 35 has a self-locking effect since an increasing tensile load on the expansion anchor 35 on account of the attachment 37 leads to a higher clamping force. In order to ensure the specified load values of a set expansion anchor 35, the expansion anchor 35 is preloaded during setting by means of the screw head 21. The expansion anchor 35 is specified with a target torque with which the screw head 21 is to be tightened when setting.

A manual setting process for the expansion anchor 35 provides for the following. In a preparatory step, a borehole is drilled into the wall 36 according to the specifications of the expansion anchor 35. The specification provides, among other things, the diameter of the borehole, which is equal to the outer diameter of the expansion mechanism 39. The expansion mechanism 39 is driven into the borehole, typically by the rotary impacts of a hammer. The attachment 37 is positioned on the screw head 21. The screw head 21 is tightened manually using a torque wrench. During tightening, the screw head 21 is supported indirectly on the wall 36 by the attachment 37 along the anchor rod 38, as a result of which the tensile stress is generated. The user stops the tightening when the torque wrench signals that the specified target torque of the expansion anchor 35 has been achieved. In some applications, the screw head 21 is then loosened again, for example in order to align the attachment 37. The user then tightens the screw head 21 again using the torque wrench and the same specified target torque. In other applications, a plurality of expansion anchors 35 are required to fasten the attachment 37. The user can first preload each of the expansion anchors 35 to an extent before the expansion anchors 35 are tightened according to the target torque. Furthermore, the user may be interrupted when tightening an expansion anchor 35, whereupon the user will hopefully continue the process later with the torque wrench.

The expansion mechanism 39 is based, for example, on a sleeve 40 and a cone 41 on the anchor rod 38. The sleeve 40 is movable relative to the cone 41 along the anchor rod 38. In the exemplary representation, the anchor rod 38 has a thinner cylindrical neck 42 which surrounds the sleeve 40. An inner diameter of the sleeve 40 is larger than the outer diameter of the neck 42. The cone 41 is arranged adjacent to the sleeve 40 on the side of the sleeve 40 facing away from the screw head 21. The lateral surface of the cone 41 tapers toward the sleeve 40. The outer diameter of the lateral surface decreases from a value greater than the inner diameter of the sleeve 40 to a value less than the inner diameter of the sleeve 40. The specified diameter of the borehole corresponds to the outer diameter of the sleeve 40, for which reason it adheres or rubs against the inner wall of the borehole. When there is tightening on the anchor rod 38 and thus on the cone 41, the sleeve 40 remains in place while the cone 41 is pulled into the sleeve 40. The cone 41 widens the sleeve 40. The sleeve 40 and the cone 41 can be designed in many ways. For example, the sleeve 40 can be provided with a plurality of tabs facing the cone 41. The sleeve 40 can be closed all around or slotted. Furthermore, the cone 41 can be conical, corrugated or pyramid-shaped. A significant aspect for the operating principle is the coefficient of friction of the sleeve 40 on the inner wall. The sleeve 40 is typically made of a steel or another iron-based material. The wall 36 is made of a mineral building material, such as concrete or natural stone.

The screw head 21 can consist, for example, of an external thread 43 on the anchor rod 38 and a nut 22 placed on the external thread 38. The nut preferably has a hexagonal circumference. Alternatively, the anchor rod 38 can have an internal thread in which a screw is inserted. The screw has a head that projects radially beyond the anchor rod 38. The head of the screw has a hexagonal circumference, for example.

"Expansion Anchor" Control Method

The impact wrench 1 implements a setting method for the expansion anchor 35; "Expansion anchor" operating mode ([0008]). The setting method is suitable for fastening an attachment 37 to a wall 36 using the expansion anchor 35. In a preparatory step, the user drills the borehole into the wall 36 and pushes the expansion anchor 35 into the borehole. The screw head 21 is tightened using the impact wrench 1. Compared to a continuously rotating electric screwdriver, the impact wrench 1 is characterized by the generation of a repeating rotary impact with momentary and therefore high torque. Furthermore, there is no rigid coupling between an output spindle 4 and a handle 7 of the impact wrench 1, for which reason a counter-torque acting back on the user is typically significantly less than the rotary impact applied. Using the input element 28, the user selects the "Expansion anchor" operating mode and specifies the type of expansion anchor 35.

A plurality of control parameters which are required for the subsequent proper execution of the setting method are assigned to each type of expansion anchor. The control parameters are stored in the memory 25 according to the type of expansion anchor. In response to the input or selection of the expansion anchor 35, the control unit 24 reads out the corresponding control parameters. The control parameters are preferably retained until the user selects a different type of expansion anchor 35. It is not necessary to select the expansion anchor 35 before each individual setting.

When the button 9 is not pressed, the electric motor 2 is disconnected from the power supply, e.g. the battery 6. A speed D of the electric motor 2 is zero or drops to zero. The separation can take place electromechanically by the button 9 itself or by an electrical switching element in the current path between the electric motor 2 and the power supply. The button 9 must be kept pressed continuously by the user throughout the setting process. If the user releases the button 9, the electric motor 2 is immediately disconnected from the power supply and the setting method is interrupted as a result. The impact wrench 1 preferably falls into a standby mode (standby) when the button 9 is released. In the standby mode, the impact wrench 1 reduces its energy consumption, in particular for a battery-powered impact wrench 1. For example, the control unit 24 can be deactivated, and reduce its functionality to simply checking the button 9 and the input element 28 et cetera.

Pressing the button 9 starts the setting method. If necessary, the impact wrench 1 is woken from the standby mode. In a preparatory phase, it can be checked whether the user has previously selected an expansion anchor 35 by means of one of the input elements 28. If a corresponding selection has not yet been made and the control parameters are not set, the user is urged to do so and the impact wrench 1 remains inactive. Otherwise, the electric motor 2 is connected to the power supply.

While in a continuously rotating screwdriver the torque output can be measured quite simply via the power consumption of the electric motor and the speed of the output spindle, this is not possible with the impact wrench 1 due to the mechanical decoupling between the output spindle 4 and the electric motor 2. Direct measurement of the torque output by means of a sensor on the output spindle is technically very demanding due to the high mechanical loads and is not suitable for the impact wrench. The setting method helps with a rough estimate of the torque M exerted in a first phase S1 and a subsequent correction in a second phase S2. The two-phase method is more robust with respect to a priori unknown influences on the setting behavior, in particular the influence of the condition of the wall 36 on the setting process.

By pressing the button 9 a pre-phase typically starts, which is not explained in more detail in the following description. During the pre-phase S1 the torque M exerted by the impact wrench 1 is so low that the impact mechanism is not triggered and the impact wrench 1 continuously exerts a typically increasing torque. The first phase S1 of the setting method starts with the first impact of the impact wrench 1 (time t0). A highly schematic curve 44 of the torque M is shown in [0009]. During the first phase S1, the torque M exerted by the output spindle 4 is estimated. The first phase S1 is ended by default when the estimated torque M exceeds a threshold value M0 (C1). The threshold value M0 is typically less than the target torque M9 for the expansion anchor 35.

During the first phase (S1), the electric motor 2 rotates the drive spindle 15 preferably at a specified first speed D1. The control unit 24 can, for example, determine the speed D of the drive spindle 15 directly with a rotation sensor 45 on the drive spindle 15 or indirectly via a rotation sensor on the electric motor 2. The first speed D1 is one of the control parameters assigned to the expansion anchor 35. The speed has an influence on the torque delivered by the impact wrench 1. The hammer 10 detaches from the anvil 11 after a rotary impact and is accelerated toward the anvil 11 by the drive spindle 15 until the next rotary impact. The next rotary impact occurs when the hammer 10 is again aligned with the anvil 11. Due to the largely predetermined acceleration path, a higher speed of the drive spindle 15 results in a higher angular velocity and a higher angular momentum of the hammer 10 in the rotary impact. In a rough approximation, it is assumed that a large part of the angular momentum is transmitted to the anvil 11 and the output spindle 4 during a rotary impact. In a series of tests, the angular momentum or a variable describing the angular momentum can be determined for different speeds and stored in a characteristic map.

During the first phase S1, the angle of rotation $\delta\phi$ by which the output spindle 4 rotates due to the rotary impact is determined. The output torque M corresponds to the transmitted angular momentum and the angle of rotation $\delta\phi$ by which the output spindle 4 rotates due to the rotary impact. Based on the determined angle of rotation $\delta\phi$ and the approximate correlation of angular momentum and speed D, the output torque M is estimated. A characteristic map which assigns a torque M or a variable describing the torque to a pairing consisting of the speed D and the angle of rotation $\delta\phi$ can be stored in the memory 25, for example.

The angle of rotation $\delta\phi$ is detected by a sensor 46 in the impact wrench 1. The sensor system 46 can directly detect the rotational movement of the output spindle 4 using a rotation sensor 47, for example. The rotation sensor 47 can inductively or optically scan markings on the output spindle 4. As an alternative or in addition, the sensor system 46 can estimate the angle of rotation $\delta\phi$ of the output spindle 4 based on the rotational movement of the drive spindle 15 between two successive rotary impacts. Between the two rotary impacts, the drive spindle 15 rotates by the angular distance between the claws 12, e.g. 180 degrees, and, if the anvil 11 has rotated, additionally by the angle of rotation $\delta\phi$ of the output spindle 4. The rotary impacts are detected by a rotary impact sensor 48. For this purpose, the sensor system 46 detects the angle of rotation of the drive spindle 15 in the time period between two immediately successive rotary impacts. The beginning and the end of the time period are detected by detection of the rotary impacts by means of a rotary impact sensor 48. The rotary impact sensor 48 can detect the increased momentary vibration in the impact wrench 1 associated with the rotary impact, for example. For example, the vibration is compared with a threshold value; the beginning or end corresponds to the point in time at which the threshold value is exceeded. The rotary impact sensor 48 can also be based on an acoustic microphone or infrasound microphone that detects a peak in volume. Another variant of a rotary impact sensor 48 detects the power consumption or a speed fluctuation of the electric motor 2. The power consumption increases briefly during the rotary impact. The angle of rotation of the drive spindle 15 can be calculated, for example, from the speed D or the signals from the rotation sensor 45 and the time period. The angle of rotation δφ of the output spindle 4 is determined as the angle of rotation of the drive spindle 15 less the angular distance between the claws 12.

The impact wrench 1 continuously compares the estimated torque M with the threshold value M0 during the first phase S1. The first phase S1 is ended immediately when the threshold value M0 is exceeded (C1). In an embodiment with the constant speed D1, the comparison of the torque M with the threshold value M0 is equivalent to a comparison of the angle of rotation per rotary impact δφ with a threshold value per rotary impact δφ0. A pairing of a speed D1 and an angle of rotation δφ0 to be undershot can be stored in the memory 25 for an expansion anchor 35. The first phase S1 is ended when the screw head 21 rotates only slightly. The detection of the angle of rotation δφ becomes increasingly inaccurate. The correlation between speed and angular momentum also decreases.

The second phase S2 immediately follows the first phase S1. The speed D of the drive spindle 15 can still be controlled to the first speed D1. During the second phase, a specified number N1 of rotary impacts are exerted. The number N1 of rotary impacts is another control parameter specific to the expansion anchor. The target torque M9 of the expansion anchor 35 is approximately achieved by the number N1 of rotary impacts. After the first phase S1, the angle of rotation δφ is approximately the same for every further rotary impact. The number N1 of rotary impacts thus corresponds to a rotation by a specified angle of rotation Δδφ1. Assuming an elastic behavior of the expansion anchor 35, the additional tensile stress of the expansion anchor 35 is largely proportional to the angle of rotation Δδφ1. The tensile stress can thus be adjusted in a metered manner via the number N1 of rotary impacts. The required number N1 of rotary impacts or the angle of rotation δφ can be determined in a series of tests for the expansion anchor 35 and the impact wrench 1 and the specified speed D1 of the second phase S2 and can be stored in the memory 25. During the second phase S2, the number N of rotary impacts exerted is counted. As stated above, the rotary impacts can be detected by means of a rotary impact sensor 48, for example. The second phase S2 ends immediately when the number N of rotary impacts reaches the target number N1 (C2).

The second phase S2 is preferably followed by a relaxation phase S3. The repetition rate of the rotary impacts is reduced compared with the second phase S2. The speed D is reduced to a second speed D2. The second speed D2 is lower than the first speed D1. In particular, the second speed D2 is below the critical speed which the impact wrench 1 needs to achieve the target torque. The second speed D2 is, for example, between 50% and 80% of the first speed D1. The relaxation phase S3 is preferably time-controlled. A duration T1 of the relaxation phase S3 is, for example, in the range between 0.5 seconds [s] and 5 s.

The previously described two-phase or three-phase setting method is suitable for tightening an expansion anchor 35 immediately after it has been inserted into the borehole. It may be the case that, for the subsequent alignment of the attachment 37, the user will loosen the tensioned expansion anchor 35 and then tighten it again. Nevertheless, repeating the two phases or three phases could damage the expansion anchor 35 or even the subsurface.

Therefore, the setting method in the "Expansion anchor" operating mode has a test routine which, at least during the first phase S1, determines whether the expansion anchor 35 has already been tightened. The exemplary test routine determines a rate of change w of the estimated torque M. As already described, the torque M increases from rotary impact to rotary impact. The rate of change w, i.e. the increase in the torque M between successive rotary impacts or averaged over several rotary impacts, has proven to be a robust characteristic which discriminates between an expansion anchor 35 that has never been tightened and an expansion anchor 35 that has been loosened again. A curve 49 of the estimated torque M for a previously loosened expansion anchor 35 is shown in [0009]. The rate of change w is characteristically greater for the expansion anchor 35 (curve 49) that has been loosened again than in the other case 44. The impact wrench 1 determines the rate of change w during the first phase S1 and compares the rate of change w with a limit value w0. The rate of change w is preferably averaged over several rotary impacts or a time window δT which typically extends over several rotary impacts. If the limit value w0 is exceeded, the impact wrench 1 ends the first phase S1. The limit value w0 is another of the control parameters which are assigned to the expansion anchor 35. The limit value w0 can be stored as a rate of change. The rate of change w can also be detected by means of a predetermined time window ΔT and a predetermined threshold value M2 of the torque M to be achieved within the time window ΔT. The time window ΔT starts with the first impact t0. If the torque M exceeds the threshold value M2 within the time window ΔT, the first phase S1 is ended when the threshold value M2 is exceeded. The time window ΔT and the threshold value M2 are stored accordingly.

The first phase S1, which ended prematurely, is followed by a modified phase S2*b*. The modified phase S2*b* is substantially the same as the second phase S2. The impact wrench 1 exerts a predetermined number N2 of rotary impacts. The number N2 is significantly less than in the second phase S2. The number N2 is less than half the number N1, for example less than a third of the number N1. The modified second phase S2*b* exerts a significantly lower additional torque on the expansion anchor 35 than is the case with the standard second phase S2. The modified second phase S2 is therefore significantly shorter than the standard second phase S2. If a relaxation phase S3 is provided, this follows the modified second phase S2*b*.

In one embodiment, the rate of change w can also be monitored during the second phase S2. If the rate of change w exceeds the specified threshold value w0, the second phase S2 is ended prematurely and the method continues with the modified second phase S2*b*.

The user may intentionally or accidentally release the button 9 during the setting process. The electric motor 2 is immediately stopped or at least disconnected from the power supply. The setting method is therefore terminated. The control method logs the set state that has been achieved in the memory 25. In particular, the memory 25 records which of the three phases of the setting process has been achieved. The impact wrench 1 can then go into standby mode S0.

The control method enables the user to complete the setting process. In one embodiment, the user is requested, for example via the display 27, to complete the setting process. The user can use the input element 28 to select whether the setting process is to be continued with the next press of the button 9 or, alternatively, a standard new setting process is to take place. The request can appear when the user presses the button 9 again, for example. Alternatively, the display 27 can permanently signal the request to the user. The user can respond to the request by means of the input element 28. As an alternative, a pressing pattern can be assigned to the button 9 in the "Continue setting process" mode. For example, tapping twice before fully pressing the button 9 corresponds to selecting "Continue setting process," while immediately pressing the button 9 corresponds to selecting "Standard new setting process." If the user does not respond to the request within a waiting period, e.g. within 30 s, the control method returns to its standard operation and will carry out the next setting process in accordance with a standard new setting process.

The standard new setting process takes place after the two or three phases described above. If the user requests a continuation of the setting process, the above setting method is modified depending on the setting status that has already been achieved.

If the setting process has been terminated during the first phase S1, the setting process starts again, i.e. with the first phase S1. The torque M is estimated or the angle of rotation $\delta\phi$ of each rotary impact is determined until the termination condition for the first phase S1 is reached, and then the subsequent phases follow.

If the setting process has been terminated during the second phase S2, only the missing rotary impacts are carried out. For this purpose, the control method stores the number of rotary impacts already carried out in the log. For the continuation, the specified number N of rotary impacts is reduced by the number of rotary impacts stored in the log. The relaxation phase S3 may follow.

If the setting process has been interrupted during the relaxation phase S3, this can be shortened by the duration already carried out before the termination. For this purpose, the control method stores the duration of the relaxation phase S3 already carried out in the case of a termination. For the continuation, the duration already carried out is read out from the memory 25 and subtracted from the specified duration.

Steel Construction

[0010] schematically shows a screw connection of two construction elements 50, 51 for steel construction in civil engineering. The two construction elements 50, 51 are to be connected in a load-bearing manner by means of one or more screw connections 52. The construction elements 50, 51 can include, for example, beams, panels, pipes, flanges, etc. The construction elements are made of steel or other metal materials. The construction elements 50, 51 are reduced to their touching planar portions in the illustration. One or more eyes 53 are provided in the portions. The eyes 53 of the two construction elements are aligned with one another by the user.

The screw connections 52 can have a typical construction with a screw head 54 on a threaded rod 55 and a screw nut 56. While the threaded rod 55 has a smaller diameter than the eyes 53, the screw head 54 and the screw nut 56 have a larger diameter than the eye 53. For other screw connections, the threaded rods can already be connected to the first construction element 50.

The user inserts the threaded rods 55 through the aligned eyes 53. The screw nut 56 is then put on. In the case of manual fastening, the user tightens the screw nut 56 using a torque wrench until a target torque specified for the screw connection is achieved. The specification is specified by the manufacturer of the screw connection or is specified in relevant standards for steel construction. The target torque ensures that the screw connection cannot loosen under load, in particular vibrations. On the other hand, the threaded rod 55 should not be loaded unnecessarily or, in the worst case, permanently damaged while tightening the screw nut 56.

Tightening the screw connections 52 with a torque wrench is a reliable and robust method, but the method is labor-intensive. Especially since the screw connection 52 typically contains many screws. The screw connections 52 could in principle be tightened using a classic electric screwdriver and a corresponding switch-off until the target torque is achieved. However, the user cannot apply the necessary holding force for the target torque and there is a considerable risk of injury to the user.

"Steel Construction" Control Method

The impact wrench 1 implements a robust setting method for the screw connection 52. The user aligns the construction elements 51 with one other, inserts the threaded rods 55 through the second construction elements 51 and puts on the screw nuts 56. The construction elements 50, 51 occasionally do not lie flat on top of one another, as shown by way of example in [0011]. In a preparatory step, the user must ensure that the construction elements 50, 51 lie flat on top of one another in the region of the screw connection 52. For this purpose, the user can tighten one or more of the screw nuts 56 by hand. The tightening torque can remain lower than the target torque M of the screw connection 52. Use of a torque wrench is optional. The user then tightens the screw connections 52 using the impact wrench 1, which tightens the screw connections 52 up to the target torque M. If the construction elements 50, 51 do not initially lie flat on top of one another, the impact wrench 1 terminates the setting process and informs the user of the missing or incomplete preparatory step. In this respect, the user selects the "Steel construction" operating mode and specifies the type of screw connection 52.

A plurality of control parameters which are required for the subsequent proper execution of the setting method are assigned to each type of screw connection 52. The control parameters are stored in the memory 25 according to type. In response to the input or selection of the screw connection 52, the control unit 24 reads out the corresponding control parameters. The control parameters are preferably retained until the user selects a different type of screw connection 52. It is not necessary to select the screw connection 52 before each individual setting.

When the button 9 is not pressed, the electric motor 2 is disconnected from the power supply, for example the battery 6, and does not rotate. The impact wrench 1 preferably falls into a standby mode when the button 9 is released. Pressing the button 9 starts the setting method. In a preparatory phase, it can be checked whether the user has previously selected the type of screw connection 52 by means of one of the input elements 28. If a corresponding selection has not yet been made and the control parameters are not set, the user is urged to do so and the impact wrench 1 remains inactive. Otherwise, the electric motor 2 is connected to the power supply.

Figure 9:
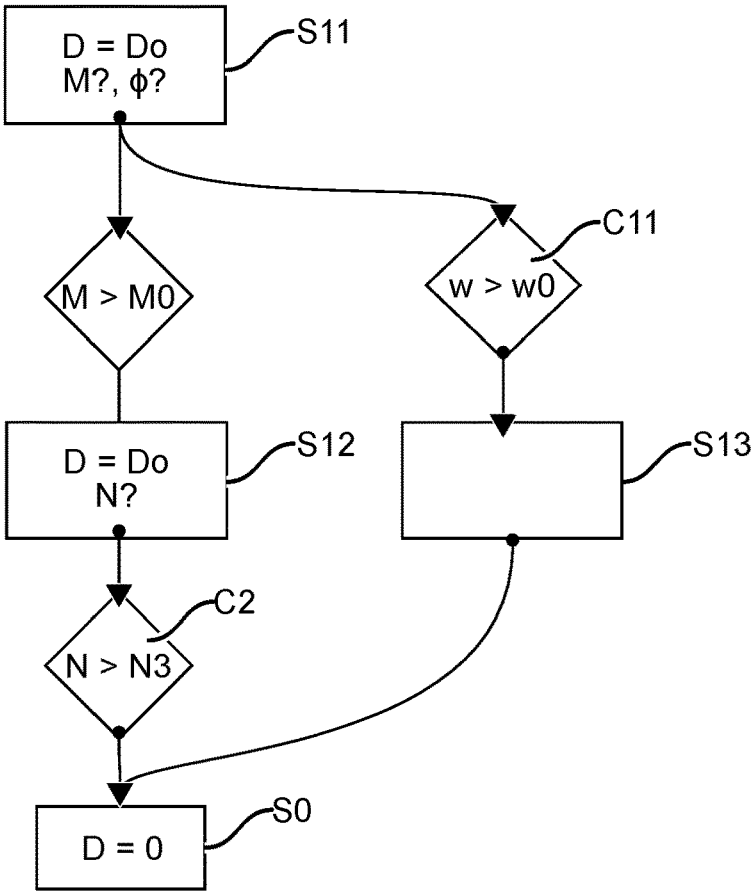
FIG. 9 is a flow chart for the "Steel construction" operating mode
Figure 10:
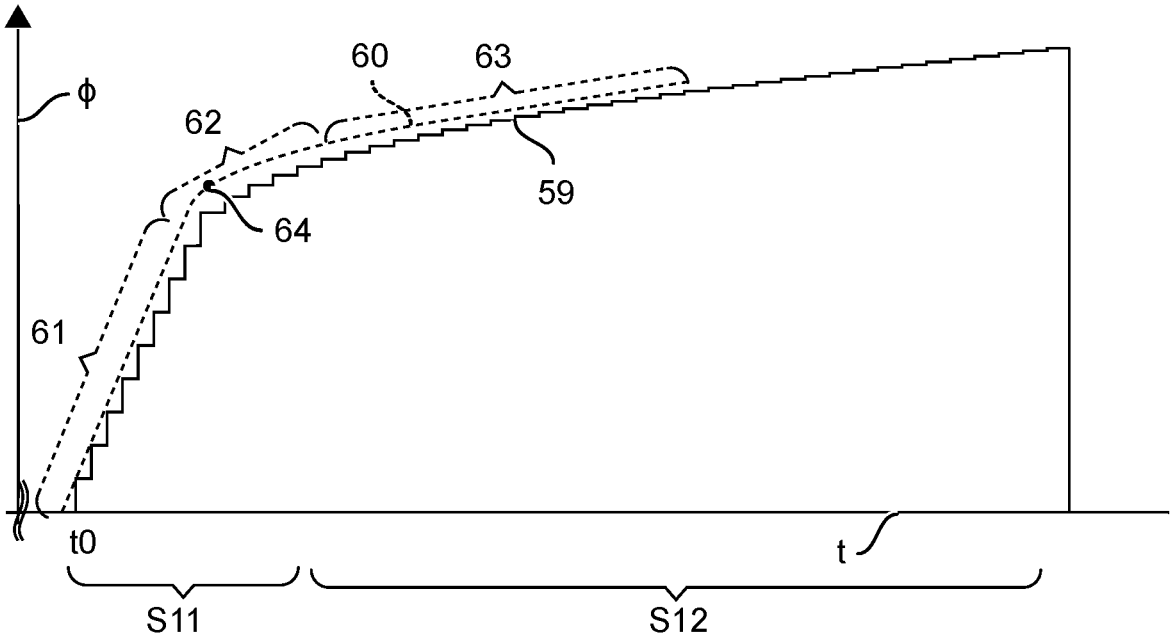
FIG. 10 shows a curve of an angle of rotation

The drive spindle 15 is accelerated in response to pressing the button 9. The spindle is accelerated to a target speed Do. Initially, the reactive torque of the screw connection 52 can be so low that the impact mechanism 3 is not activated. This pre-phase is not described in more detail below. The first phase S11 of the setting method as shown in FIG. 9 starts with the first impact of the impact mechanism 3. During the first phase S11, the torque M exerted by the output spindle 4 is estimated. The first phase S11 is ended by default when the estimated torque M exceeds a threshold value M0. The threshold value M0 is typically less than the target torque M9 for the screw connection 52. The torque M is estimated as described in connection with the phase S1 for tightening an expansion anchor. The control parameters required for this are stored in the memory 25 for the screw connection 52.

The second phase S12 immediately follows the first phase S11. The speed D of the drive spindle 15 can still be controlled to the target speed Do. During the second phase, a specified number N3 of rotary impacts are exerted. The number N3 of rotary impacts is another control parameter specific to the expansion anchor. The target torque of the screw connection 52 is approximately achieved by the number N3 of rotary impacts. The second phase S12 largely corresponds to the second phase S2 when setting an expansion anchor 35.

The described two-phase "Steel construction" setting method is suitable for tightening a screw connection 52 in order to connect two steel construction elements 50, 51, provided that they lie flat on top of one another. During the first phase S11, a test routine C1 is active which estimates whether the steel construction elements 50, 51 lie flat on top of one another. If the test routine C1 detects that the elements are lying flat on top of one another, the setting method is carried out with the phases described above until it is complete. If the test routine finds that the elements do not lie flat on top of one another, a protection routine S13 is executed. The protection routine S13 can immediately terminate the setting method in a simple implementation. The display 27 of the impact wrench 1 can give a corresponding indication as to why the setting method was terminated.

The test routine C11 estimates the angle of rotation ϕ of the screw connection starting from the first impact (time t0). A curve 57 of the angle of rotation ϕ over time is compared with stored control parameters for the screw connection 52. The angle of rotation ϕ is preferably averaged from several measurement points. [0012] shows the curve 57 of the angle of rotation ϕ. The angle of rotation ϕ, which increases substantially in stages, can be detected only with a lot of noise in practice. The rate of increase of the angle of rotation ϕ can be measured for each type of screw connection 52 from a series of tests. The curve is essentially determined by the elastic behavior of the screw connection 52. The construction elements 50, 51—if they lie flat on top of one another—have only a minor influence on the curve. On the other hand, in the case of construction elements 50, 51 which do not lie flat on top of one another, the rigidity thereof and a gap between the construction elements 50, 51 prevail over the rigidity of the overall system. The rigidity is typically reduced. With the same impact power, a greater progress of the angle of rotation ϕ is observed over time. The control parameters describe an upper limit 58, which the angle of rotation ϕ must not exceed during tightening. Exceeding the upper limit 58 is recognized as the elements not lying flat on top of one another. The test routine prompts the setting method to be terminated S13. The upper limit 58 is preferably not a fixed value, but a value that increases with time or with the number of impacts. The test routine is preferably activated with the first impact at time t0. The test routine is preferably ended after a predetermined time period ΔT, for example the test routine is ended at the end of the first phase S11. The upper limit 58 can be determined for different screw connections 52, in particular different screw diameters, by means of a series of tests.

Steel Construction II

Figure 11:
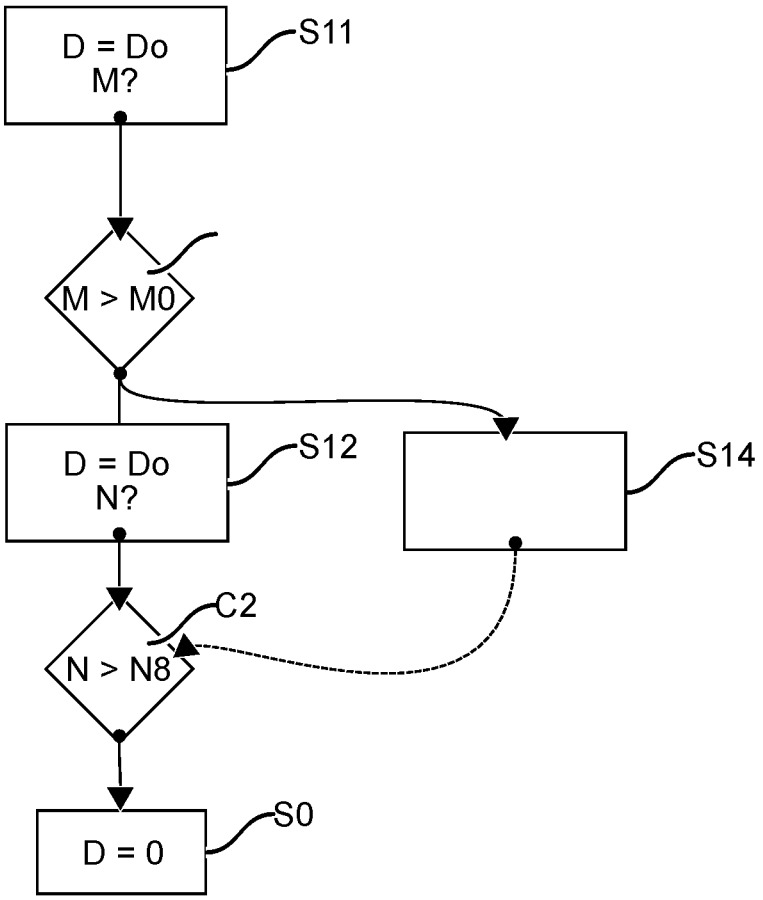
FIG. 11 is a flow chart for the "Steel construction II" operating mode

An alternative setting method "Steel construction II" shown in FIG. 11 goes through the first phase S11 and the second phase S12 as described above. However, the number N8 of rotary impacts for the second phase S12 is not predetermined, but is derived from the curve 59 of the angle of rotation ϕ during the previous setting process. An estimation routine S14 compares the curve 59 of the angle of rotation ϕ over time t with a set of patterns 60 ([0014]). The patterns 60 are typical curves of the angle of rotation ϕ, determined from a series of tests, when tightening screw connections 52 in steel construction. The estimation routine S14 determines the pattern 60 closest to the current curve 59. The number N8 of rotary impacts for the second phase S12 is assigned to the pattern 60 in a lookup table.

[0014] shows an example of a curve 59 in which the construction elements 51 lie flat on top of one another. The exemplary patterns 60 have three sections: a beginning 61, a middle 62 and an end 63. The beginning has a linear curve with a first slope. The end has a linear curve with a second slope, which is less than the first slope. The middle 62 is described, for example, by an exponential function with a monotonically decreasing slope. Alternatively, the middle can be described by other functions with a continuously monotonically decreasing slope, e.g. exponential function, hyperbola. The transitions between the sections are preferably smooth. The pattern has four to six degrees of freedom. The degrees of freedom are or describe, among other things, the slope of the beginning, the slope of the end, the duration of the beginning and the duration of the middle. The curve can be compared with the pattern by means of curve fitting, in which the numerical values for the degrees of freedom are varied, e.g. using the least squares method. The patterns 60 are expediently provided for different types of screw connections 52 in a memory 25. The user preferably enters the type via the input element 28 before tightening the screw connection 52. The estimation routine S14 limits the adaptation to the patterns 60 belonging to the selected type.

The estimation routine S14 preferably records the angle of rotation ϕ over time t starting with the first impact t0 in order to obtain measurement points for the comparison. A measurement point contains the measured angle of rotation ϕ and the associated time t. The angle of rotation ϕ can be estimated based on the angle of rotation of the drive spindle 15 between successive rotary impacts. Time recording can be approximated by chronological recording of the angle of rotation ϕ. The measurement points can be stored in an intermediate memory.

The estimation routine S14 adapts the pattern 60 to the measurement points. For a meaningful result of the adjustment, this is preferably carried out after a minimum number of rotary impacts. It has also proven to be advantageous to carry out the adaptation at the beginning of the second phase S12, i.e. when the estimated torque M exceeds a threshold value M0. The adaptation can be carried out repeatedly, provided that this is permitted by the computing power of the impact wrench 1. Alternatively, the estimation routine S14 is executed only once.

The estimation routine S14 is completed when a deviation of the pattern 60 from the measurement points lies within a specified tolerance. If, after a specified number of rotary impacts or a specified duration, the pattern deviates from a tolerance or the minimum number of measurement points for the end of the pattern is undershot, an error message is output and the setting method is terminated.

The determined pattern 60 provides information about the elastic behavior of the screw connection 52. Based on the elastic behavior, the number N8 of required rotary impacts for the second phase S12 can be derived. In one embodiment, values for N8 associated with the patterns 60 are stored. Instead of a lookup table, an algorithm can determine the target number N8 from the numerical values. As soon as the estimation routine S14 has determined the target number N8 of rotary impacts for the second phase S12, the target number N8 for the second phase S12 is set. The setting method counts the number of rotary impacts exerted starting from the change from the first phase S11 to the second phase S12. As soon as the number N8 is reached, the setting method is ended. The start of the second phase S12 is preferably before the target number N8 is set.

The change from the first phase S11 to the second phase S12 is based on an estimate of the reactive torque M. This estimate is subject to a significant measurement error. One embodiment determines, based on the pattern 60, with which rotary impact 64 the threshold value M0 was exceeded. The previous change from the first phase S11 to the second phase S12 may have occurred at a rotary impact other than the rotary impact 64. The estimation routine S14 can adapt the target number N8 according to the deviation.

What is claimed is:

1. A setting method for an expansion anchor via an impact wrench, the setting method comprising:

a first phase, in which a rotary impact is repeatedly exerted on a screw element of the expansion anchor and a torque transmitted from a rotary impact to the screw head of the screw element is estimated until the estimated transmitted torque exceeds a threshold value specified for the expansion anchor;

a second phase, in which a first number of rotary impacts specified for the expansion anchor are exerted on the screw head; and monitoring during at least during the first phase a current rate of change of the estimated transmitted torque is monitored and, in response to the current rate of change exceeding a limit value for the rate of change specified for the expansion anchor, a modified second phase is started, in which a second number of rotary impacts specified for the expansion anchor are exerted on the screw head, the second number being less than the first number.

2. The setting method as recited in claim 1 wherein the limit value for the rate of change is defined by a time window and a second threshold value for the estimated transmitted torque, the second threshold value to be achieved within the time window.

3. The setting method as recited in claim 1 further comprising a third phase, a repetition rate of the rotary impacts being reduced compared with the second phase in the third phase.

4. The setting method as recited in claim 1 further comprising detecting the expansion anchor before the start of the first phase and setting the threshold value, the specified first number of rotary impacts, the specified second number of rotary impacts and the limit value on the basis of the detected expansion anchor.

* * * * *